US011357680B2

(12) United States Patent
Kung

(10) Patent No.: US 11,357,680 B2
(45) Date of Patent: Jun. 14, 2022

(54) SIT ASSIST DEVICE

(71) Applicant: Chi Hung Kung, Hong Kong (CN)

(72) Inventor: Chi Hung Kung, Hong Kong (CN)

( * ) Notice: Subject to any disclaimer, the term of this patent is extended or adjusted under 35 U.S.C. 154(b) by 211 days.

(21) Appl. No.: 16/634,082

(22) PCT Filed: Sep. 3, 2018

(86) PCT No.: PCT/CN2018/103847
§ 371 (c)(1),
(2) Date: Jan. 24, 2020

(87) PCT Pub. No.: WO2019/020127
PCT Pub. Date: Jan. 31, 2019

(65) Prior Publication Data

US 2020/0206049 A1 Jul. 2, 2020

(30) Foreign Application Priority Data

Jul. 26, 2017 (HK) ..... 17107476.9

(51) Int. Cl.
*A47C 7/35* (2006.01)
*A61G 5/14* (2006.01)
*A47C 7/02* (2006.01)

(52) U.S. Cl.
CPC ..... *A61G 5/14* (2013.01); *A47C 7/021* (2013.01); *A47C 7/35* (2013.01); *A61G 2200/34* (2013.01); *A61G 2200/36* (2013.01)

(58) Field of Classification Search
CPC .. A61G 5/14; A61G 2200/34; A61G 2200/36; A47C 7/021; A47C 7/35
See application file for complete search history.

(56) References Cited

U.S. PATENT DOCUMENTS 3,659,897 A * 5/1972 Wright ..... A47C 7/445 297/337
4,249,774 A * 2/1981 Andreasson ..... A61G 5/14 297/311

(Continued)

FOREIGN PATENT DOCUMENTS

CN 101332024 A 12/2008
CN 102273836 A 12/2011

(Continued)

OTHER PUBLICATIONS

World Intellectual Property Organization, International Search Report for International Application No. PCT/CN2018/103847, dated Nov. 29, 2018, 4 total pages.

(Continued)

*Primary Examiner* — Philip F Gabler
(74) *Attorney, Agent, or Firm* — SoCal IP Law Group LLP; Mark Andrew Goldstein

(57) ABSTRACT

A sit assist device (1) comprising a base (2) adapted to be supported by a seating surface, and a sitting platform (3) hingedly connected to the base (2) and movable between a raised position and a lowered position to assist a user to sit down onto and to stand up from the sitting platform (3). A primary biasing means (4) provides a primary resilient bias to resiliently bias the sitting platform (3) from the lowered position to the raised position over an operating range, thereby moving the sitting platform (3) from the lowered position to the raised position over the operating range as the user stands up from the sitting platform (3) and slowing the movement of the sitting platform (3) from the raised position to the lowered position over the operating range as the user sits down onto the sitting platform (3). A secondary biasing means (5) provides a secondary resilient bias to supplement (Continued)

the primary resilient bias over a portion of the operating range adjacent the lowered position.

20 Claims, 18 Drawing Sheets

(56) References Cited

U.S. PATENT DOCUMENTS

| | | | | |
|---|---|---|---|---|
| 4,907,303 | A * | 3/1990 | Baird | A61G 5/14 292/171 |
| 5,082,327 | A * | 1/1992 | Crisp | A61G 5/14 297/313 |
| 5,116,100 | A * | 5/1992 | Iversen | A61G 5/14 297/257 |
| 5,898,953 | A * | 5/1999 | Paxon | A61G 5/14 4/248 |
| 5,918,936 | A | 7/1999 | Murphy | |
| 6,113,188 | A * | 9/2000 | Stewart | A61G 5/14 297/339 |
| 6,754,917 | B1 * | 6/2004 | Rhoades | A61G 7/1007 4/667 |
| 7,434,882 | B1 * | 10/2008 | Hodges | A61G 5/14 257/E21.694 |
| 8,210,295 | B2 * | 7/2012 | Kuramoto | A61G 5/125 180/65.51 |
| 2006/0189436 | A1 | 8/2006 | Nakashima et al. | |
| 2015/0305959 | A1 * | 10/2015 | Borgman | A47C 7/144 601/136 |
| 2015/0366729 | A1 | 12/2015 | Quick et al. | |
| 2016/0374879 | A1 * | 12/2016 | Christian | A47C 3/18 297/313 |

FOREIGN PATENT DOCUMENTS

| | | | |
|---|---|---|---|
| CN | 103584546 | A | 2/2014 |
| CN | 106963160 | A | 7/2017 |
| CN | 208941401 | U | 6/2019 |
| HK | 1800398 | | 7/2018 |
| HK | 1248453 | A | 10/2018 |
| WO | 2019020127 | A1 | 1/2019 |

OTHER PUBLICATIONS

World Intellectual Property Organization, International Written Opinion for International Application No. PCT/CN2018/103847, dated Nov. 23, 2018, 4 total pages.

European Patent Office, Supplementary European Search Report for EP 18 83 8482, dated Jul. 21, 2021, 5 total pages.

* cited by examiner

SIT ASSIST DEVICE

RELATED APPLICATION INFORMATION

This patent claims priority from International PCT Patent Application No. PCT/CN2018/103847, filed Sep. 3, 2018 entitled, "SIT ASSIST DEVICE", which claims priority to Chinese Patent Application No. 17107476.9, filed Jul. 26, 2017 all of which are incorporated herein by reference in their entirety.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

FIELD OF THE INVENTION

The invention relates to sit assist devices, particularly sit assist devices for assisting users to sit down onto and stand up from a seat. The present invention is described herein primarily in relation to, but is not limited to, portable sit assist devices adapted to be supported by a seating surface.

BACKGROUND OF THE INVENTION

Sit assist devices assist a user to sit down and stand up from a seat. There are many reasons why such devices are needed or desired. For example, the user may be infirm, elderly, have a disability, or an injury, or is recovering from an injury, or some other condition that affects her/his mobility or balance and impairs their ability to sit down or to stand up.

Prior devices typically comprise a base and a sitting platform connected by some sort of spring. One comprises a base hingedly connected to the sitting platform with a spring damper cylinder connected in between. The sitting platform is resiliently biased into a raised position. The raised sitting platform allows the user to contact the sitting platform whilst still standing or at the start of sitting down thereby providing support during this early stage. As the user sits down, the resilient bias slows down the user as the sitting platform moves to a lowered position. As the user starts to stand up, the resilient bias urges the sitting platform to the raised position thereby providing an upward force to the user and assisting her/him to stand up.

Since the physical attributes of users, such as weight, can vary, it is difficult to design a device with a resilient bias that provides a suitable degree of support or a suitable degree of support over the whole operating range from the raised position to the lowered position of the sitting platform. For example, a device that provides suitable support for a heavy user may have a resilient bias that is too strong for a light user, with the result that the sitting platform will not move from the raised position to the lowered position when the light user sits down.

Furthermore, in devices with a spring damper cylinder, the spring damper cylinder is typically hingedly connected at one end to one point on the base and hingedly connected at another end to one point on the sitting platform, with the sitting platform hingedly connected to the base. As the sitting platform moves between the raised and lowered positions, the spring damper cylinder moves through a range of tilt angles. This leads to the problem that the force provided by the spring damper cylinder varies as the sitting platform moves between the raised position and the lowered position. One particular problem is that the force provided by the spring damper cylinder is quite weak in the vicinity of the lowered position since the spring damper cylinder is operating at a very shallow angle from the base in the vicinity of the lowered position.

Other prior sit devices include those that are powered. For example, some sit assist devices include an electric motor to move the sitting platform between the raised and lowered positions via gearing, or hydraulic or pneumatic cylinders powered by the electric motor. Such devices however have the disadvantages that the devices are heavy, have compromised or no portability, are complex and more expensive, require a nearby power source, require maintenance and are prone to breakdown, and can introduce safety hazards to the user not present in non-powered devices.

It is an object of the present invention to overcome or ameliorate at least one of the disadvantages of the prior art, or to provide a useful alternative.

SUMMARY OF THE INVENTION

An embodiment of the present invention provides a sit assist device comprising:

- a base adapted to be supported by a seating surface;
- a sitting platform hingedly connected to the base and movable between a raised position and a lowered position to assist a user to sit down onto and to stand up from the sitting platform;
- a primary biasing means providing a primary resilient bias to resiliently bias the sitting platform from the lowered position to the raised position over an operating range, thereby moving the sitting platform from the lowered position to the raised position over the operating range as the user stands up from the sitting platform and slowing the movement of the sitting platform from the raised position to the lowered position over the operating range as the user sits down onto the sitting platform; and
- a secondary biasing means providing a secondary resilient bias to supplement the primary resilient bias over a portion of the operating range adjacent the lowered position.

In one embodiment, the primary biasing means comprises one or more of the following: a primary coil spring; a primary pneumatic spring; and a primary hydraulic spring.

In one embodiment, the primary biasing means comprises a primary spring damper. In one embodiment, the primary spring damper is hingedly connected at one end to the base and hingedly connected at another end to the sitting platform.

In one embodiment, the secondary biasing means comprises one or more of the following: a secondary coil spring; and a secondary leaf spring.

In one embodiment, the secondary biasing means comprises at least one secondary coil spring mounted vertically on the base and having a height lower than the sitting platform in the raised position such that the sitting platform engages the secondary coil spring only when the sitting platform is lowered towards the lowered position, thereby providing the secondary resilient bias to supplement the primary resilient bias over a portion of the operating range adjacent the lowered position.

In another embodiment, the secondary biasing means comprises at least one secondary coil spring connected at one end to the base and connected to the sitting platform at another end, the secondary coil spring configured to provide the secondary resilient bias to supplement the primary resilient bias over a portion of the operating range adjacent the lowered position.

In one embodiment, the secondary biasing means comprises a respective spring cover covering each secondary coil spring.

In one embodiment, the secondary biasing means comprises at least one secondary coil spring, the secondary coil spring forming part of a hinge hingedly connecting the sitting platform to the base. In one embodiment, the hinge comprises a cylindrical portion, the secondary coil spring has a lower arm portion, an upper arm portion, and a coil portion between the upper and lower arm portions, with the coil portion sleeved over the cylindrical portion, the upper arm portion engaged with the sitting platform, and the lower arm portion engaged with the base, the secondary coil spring configured to provide the secondary resilient bias to supplement the primary resilient bias over a portion of the operating range adjacent the lowered position.

In one embodiment, the primary biasing means operates along a longitudinal axis and is positioned with the longitudinal axis substantially aligned with a central front-to-back axis running from a centre front of the base to a centre rear of the base, the secondary biasing means having two of said secondary coil springs positioned on either side of the longitudinal axis.

In one embodiment, the secondary biasing means comprises at least one secondary leaf spring having a lower arm portion, an upper arm portion, and a resilient elbow portion between the upper and lower arm portions, with the lower arm portion connected to the base and the upper arm portion connected to the sitting platform, the secondary leaf spring configured to provide the secondary resilient bias to supplement the primary resilient bias as the upper and lower arm portions are urged together over a portion of the operating range adjacent the lowered position.

In one embodiment, the secondary leaf spring forms at least part of a hinge hingedly connecting the sitting platform to the base.

In one embodiment, the secondary biasing means comprises at least one secondary leaf spring having a lower arm portion, an upper arm portion, and a resilient elbow portion between the upper and lower arm portions, with the lower arm portion connected to the base and the upper arm portion unconnected to and lower than the sitting platform in the raised position such that the sitting platform engages the secondary leaf spring only when the sitting platform is lowered towards the lowered position, thereby providing the secondary resilient bias to supplement the primary resilient bias as the upper and lower arm portions are urged together over a portion of the operating range adjacent the lowered position.

In one embodiment, the primary biasing means is hingedly connected at one end to the base and hingedly connected at another end to the sitting platform, one or both of the ends of the primary biasing means being movable along a plurality of connection points running along the base and/or the sitting platform to adjust the raised position and/or a force profile of the primary biasing means over the operating range.

In one embodiment, the sitting platform comprises a front portion and a rear portion, the front portion being hingedly connected to the base, and the front and rear portions are hingedly interconnected such that the rear portion maintains a substantially horizontal configuration when the user sits down onto the sitting platform as the sitting platform moves from the raised position to the lowered position, and/or when the user stands up from the sitting platform as the sitting platform moves from the lowered position to the raised position. In one embodiment, the hinged connection is in the form of a weakened section integral with the sitting platform between the front and rear portions.

In some embodiments, the base is a single integrated unit and/or the sitting platform is a single integrated unit. In some embodiments, the base is a single molded unit and/or the sitting platform is a single molded unit.

In one embodiment, the sitting platform comprises a rigid portion and a cushioned portion mounted to the rigid portion for the user to sit upon.

Throughout this specification, including the claims, the words "comprise", "comprising", and other like terms are to be construed in an inclusive sense, that is, in the sense of "including, but not limited to", and not in an exclusive or exhaustive sense, unless explicitly stated otherwise or the context clearly requires otherwise.

BRIEF DESCRIPTION OF THE FIGURES

Preferred embodiments in accordance with the best mode of the present invention will now be described, by way of example only, with reference to the accompanying figures, in which the same reference numerals refer to like parts throughout the figures unless otherwise specified, and in which.

DETAILED DESCRIPTION OF PREFERRED EMBODIMENTS OF THE INVENTION

Figure 1:
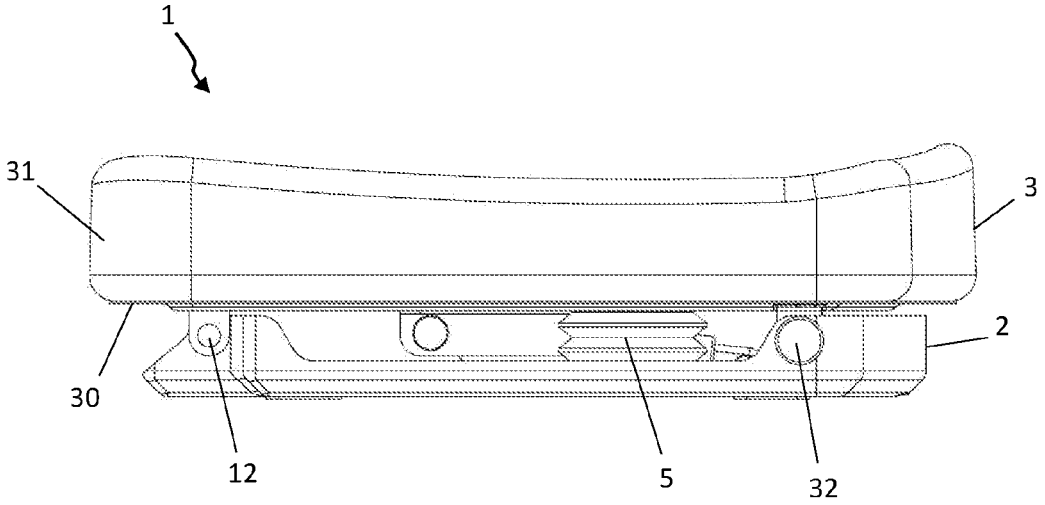
FIGS. 1 and 2 are each a right side view of a sit assist device in accordance with an embodiment of the present invention, shown in a lowered position in FIG. 1 and a raised position in FIG. 2.
Figure 2:
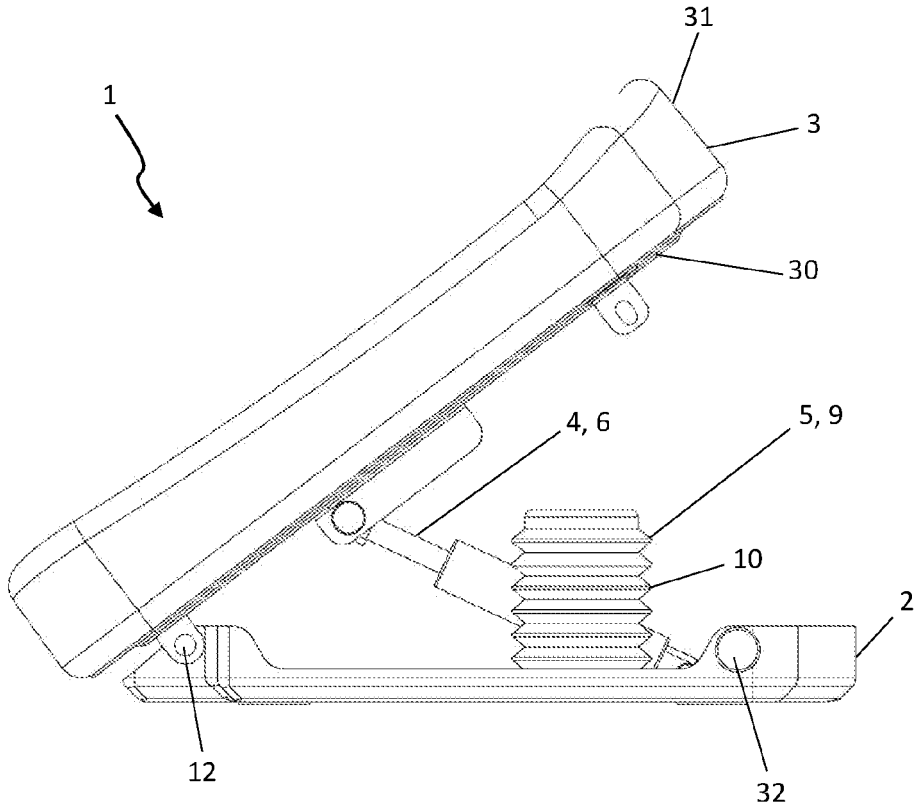
Figure 3:
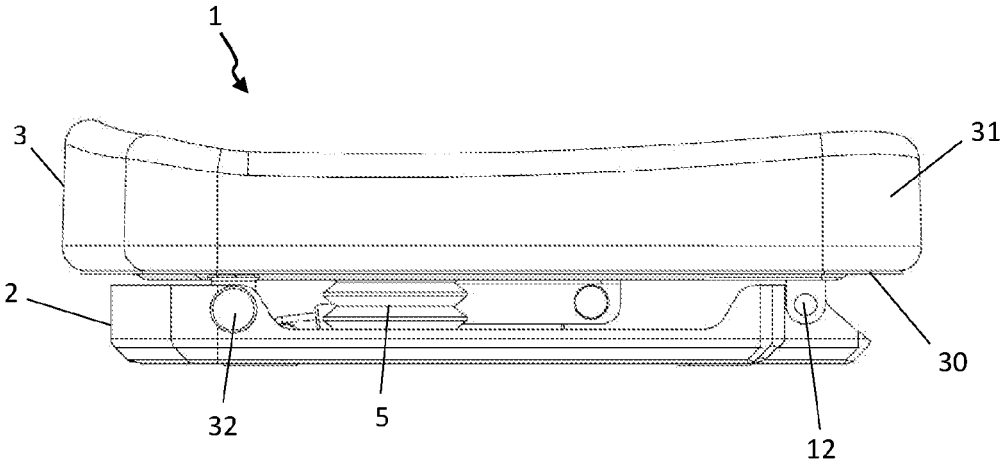
FIGS. 3 and 4 are each a left side view of the sit assist device of FIG. 1, shown in a lowered position in FIG. 3 and a raised position in FIG. 4.
Figure 4:
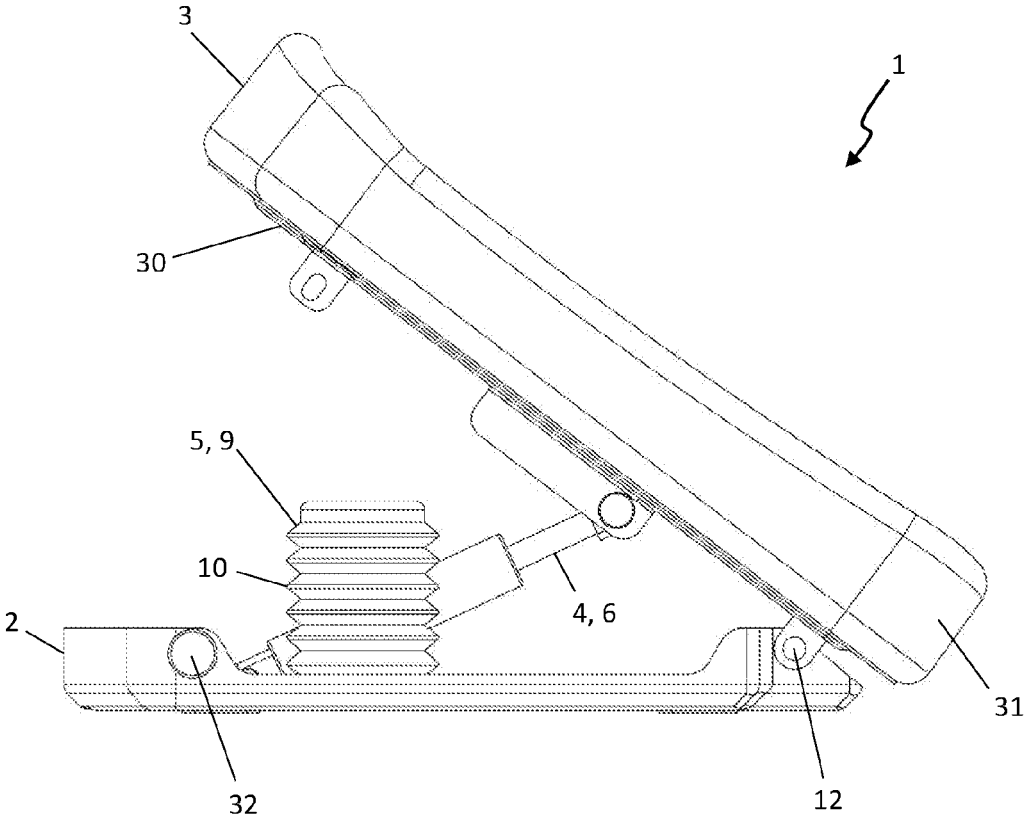
Figure 5:
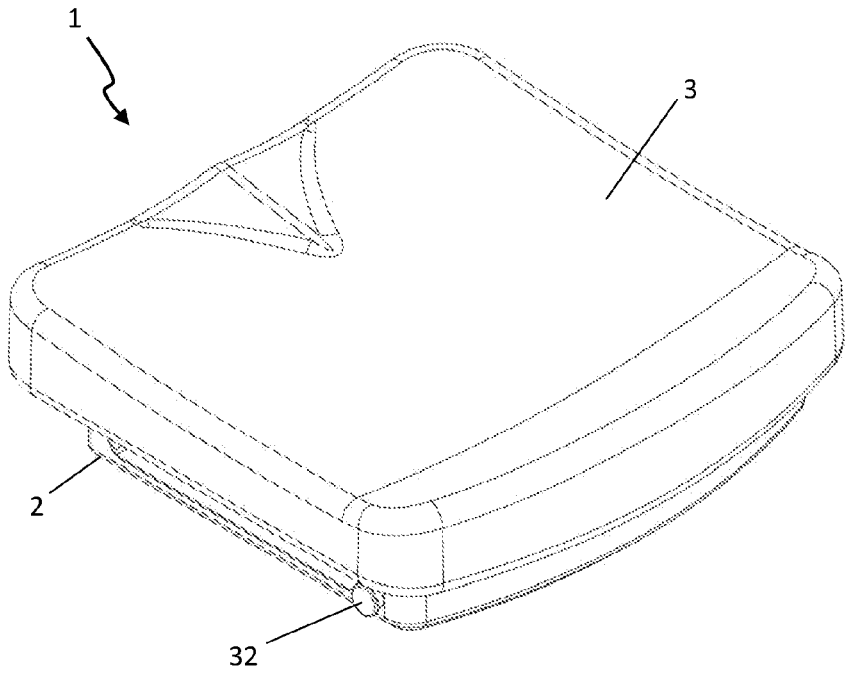
FIGS. 5 and 6 are each a top rear right isometric view of the sit assist device of FIG. 1, shown in a lowered position in FIG. 5 and a raised position in FIG. 6.
Figure 6:
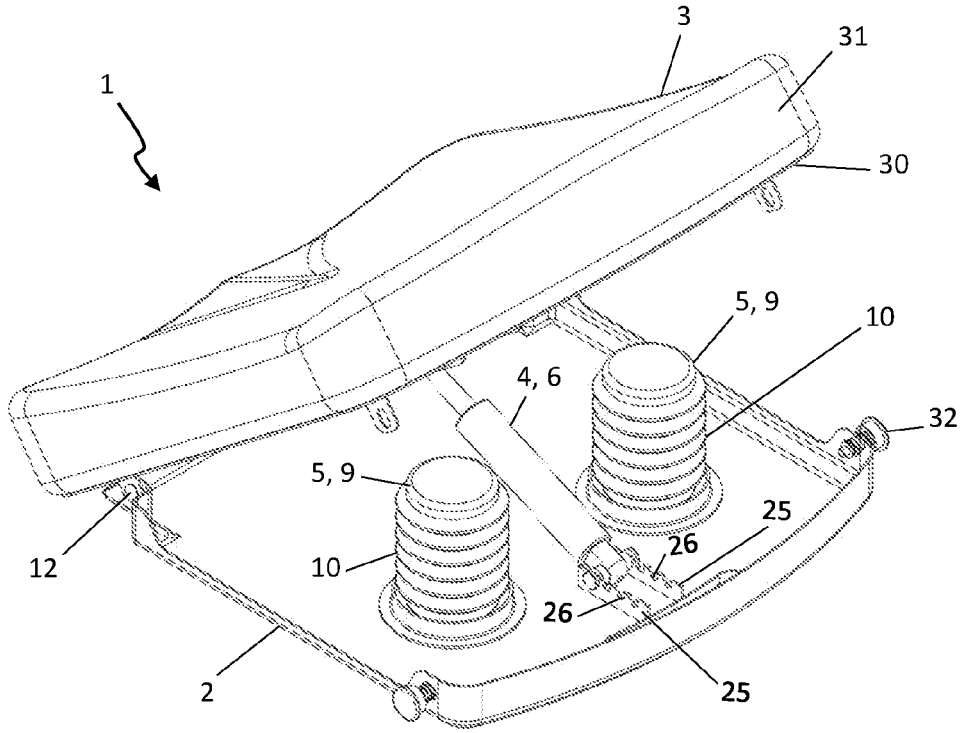
Figure 7:
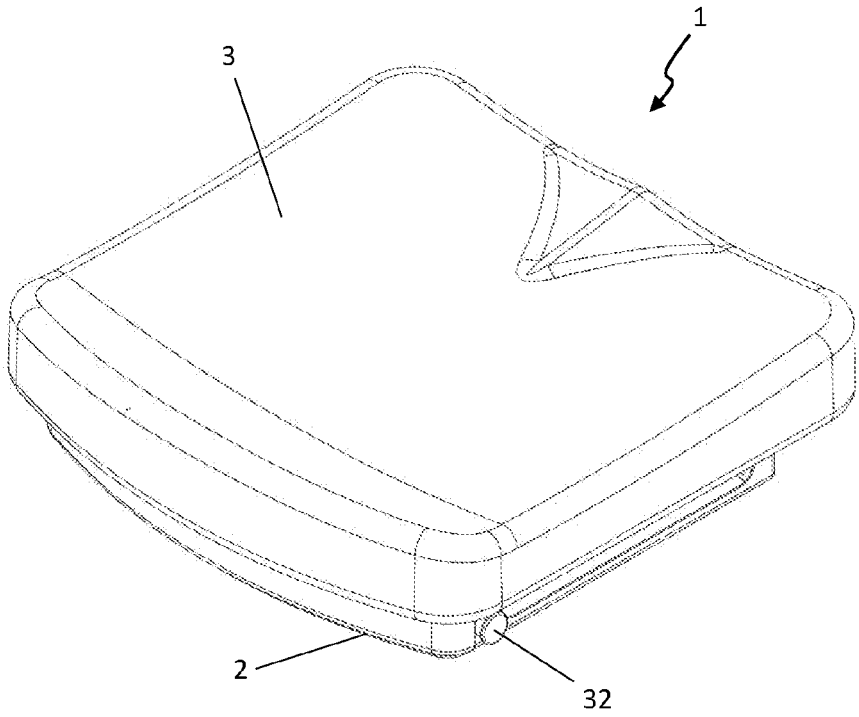
FIGS. 7 and 8 are each a left rear right isometric view of the sit assist device of FIG. 1, shown in a lowered position in FIG. 7 and a raised position in FIG. 8.
Figure 8:
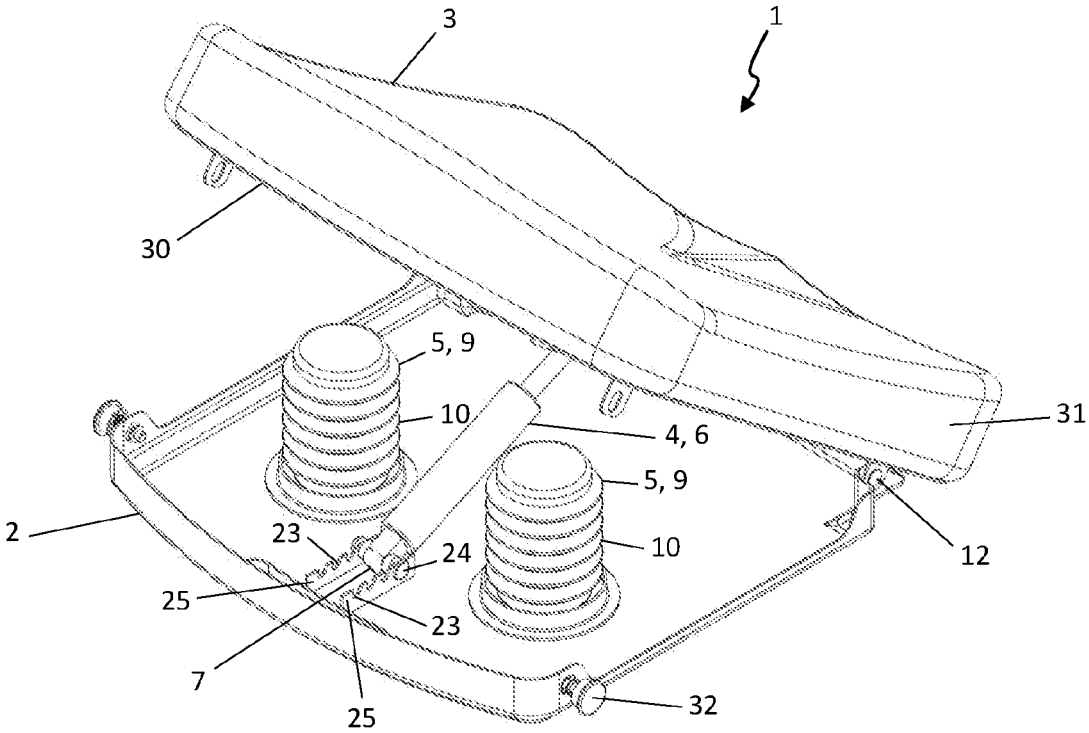
Figure 9:
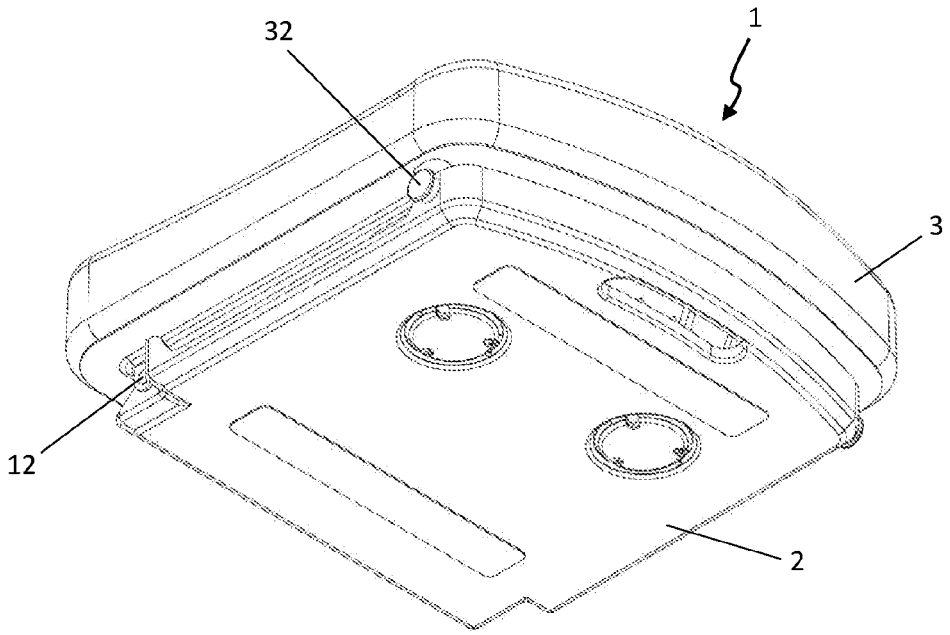
FIGS. 9 and 10 are each a bottom rear right isometric view of the sit assist device of FIG. 1, shown in a lowered position in FIG. 9 and a raised position in FIG. 10.
Figure 10:
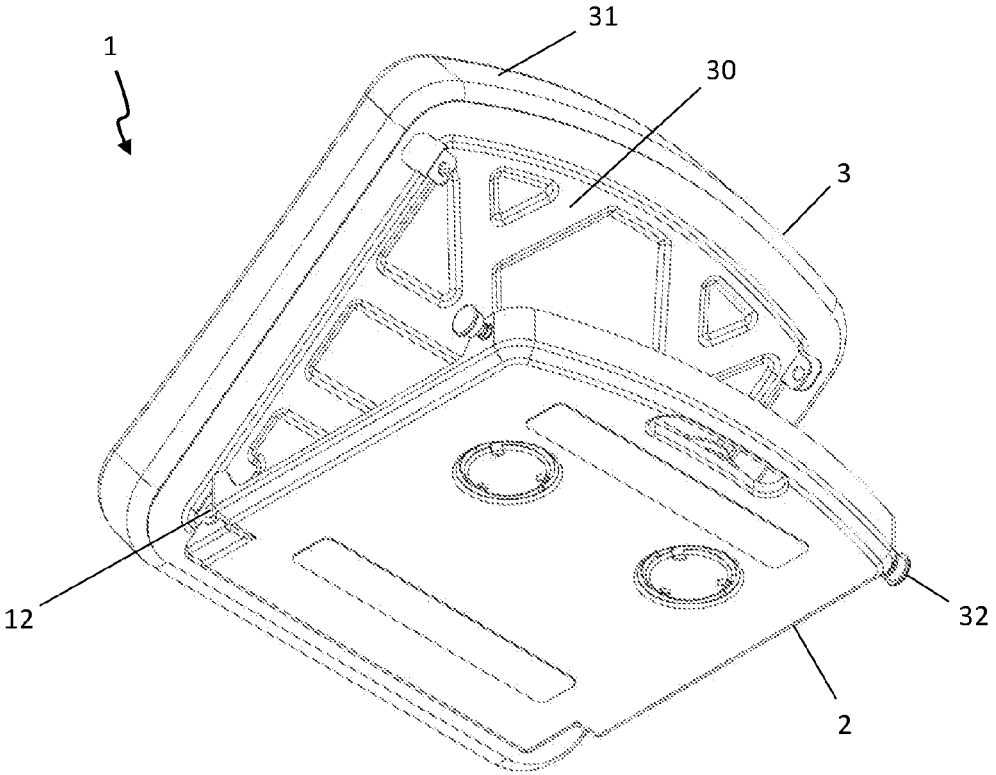
Figure 11:
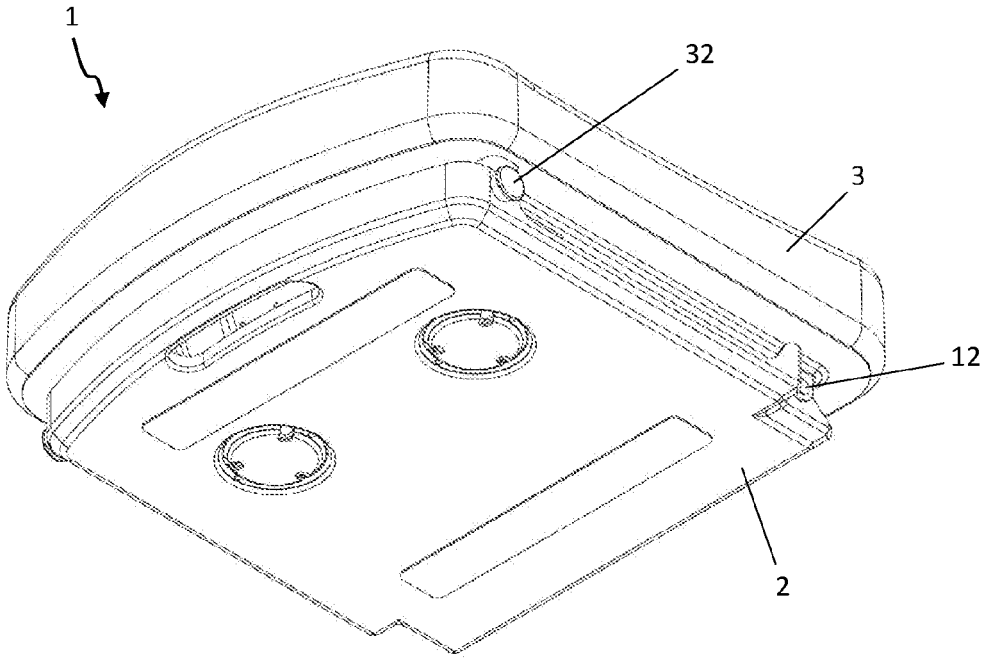
FIGS. 11 and 12 are each a bottom rear left isometric view of the sit assist device of FIG. 1, shown in a lowered position in FIG. 11 and a raised position in FIG. 12.
Figure 12:
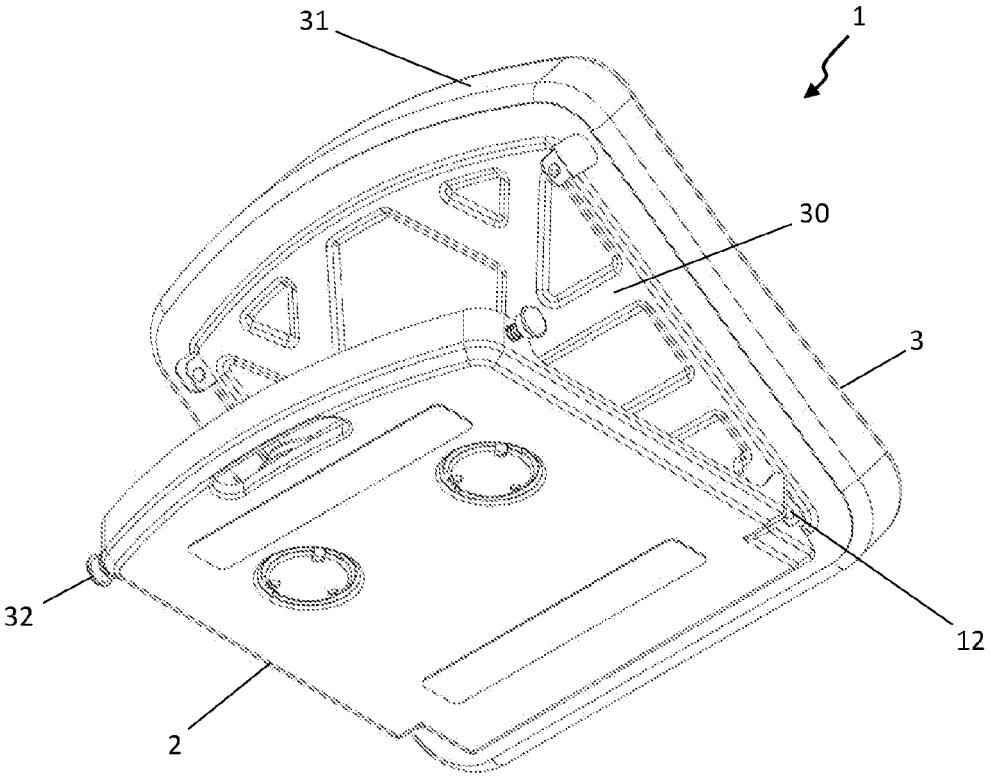
Figure 13:
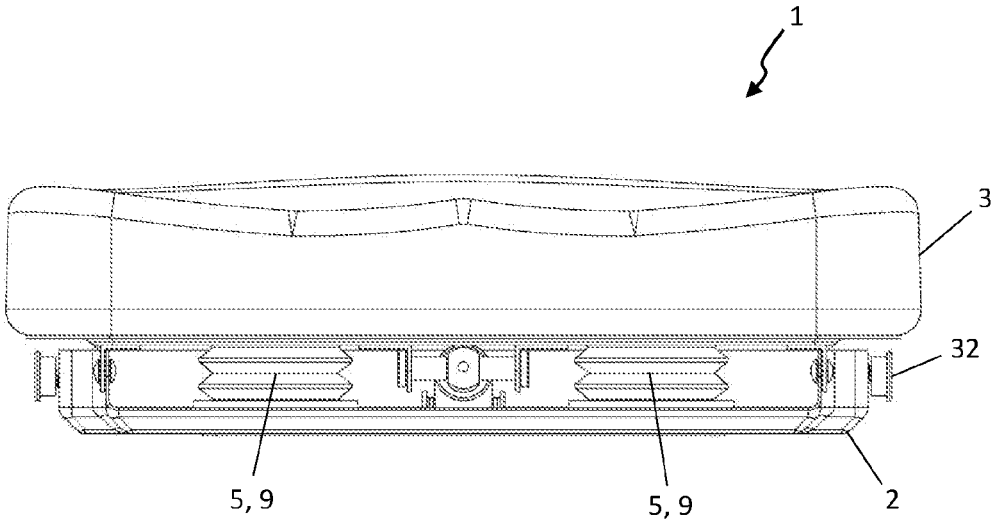
FIGS. 13 and 14 are each a rear view of the sit assist device of FIG. 1, shown in a lowered position in FIG. 13 and a raised position in FIG. 14.
Figure 14:
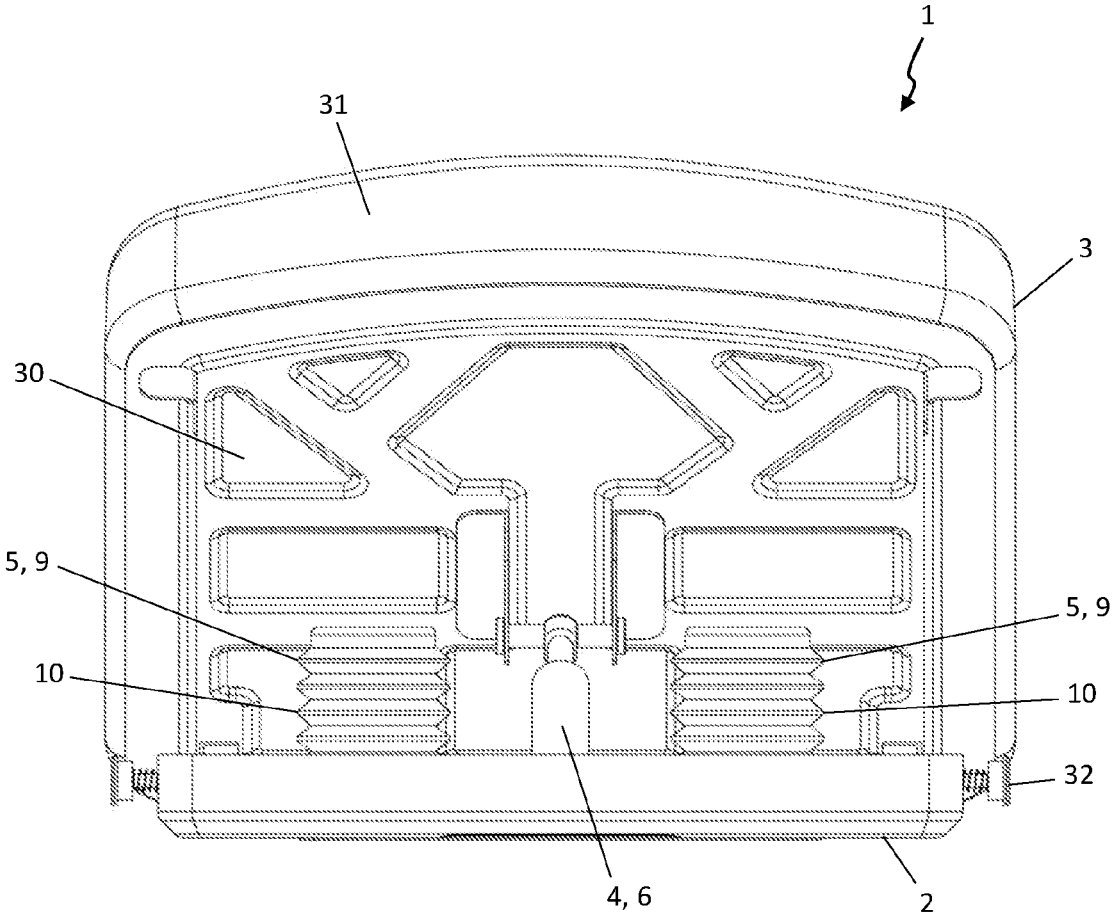
Figure 15:
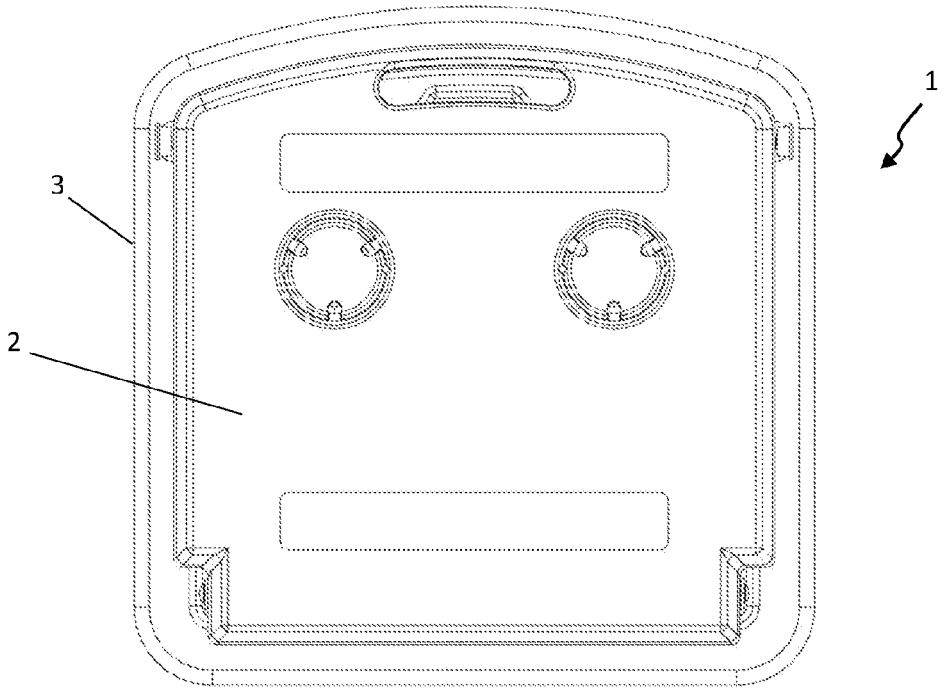
FIGS. 15 and 16 are each a bottom view of the sit assist device of FIG. 1, shown in a lowered position in FIG. 15 and a raised position in FIG. 16.
Figure 16:
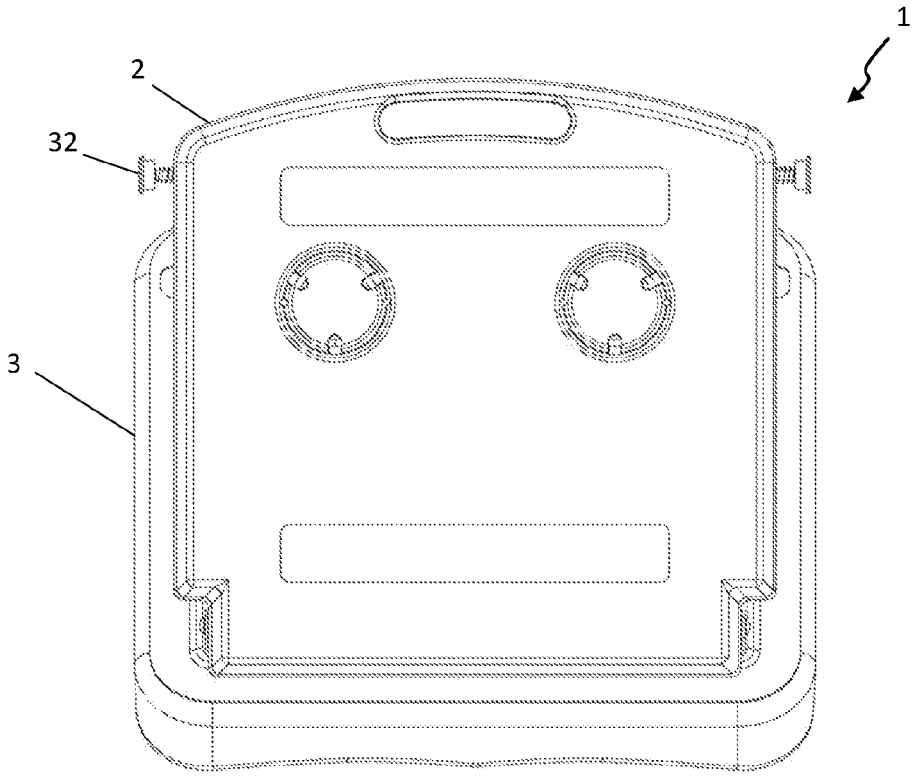
Figure 17:
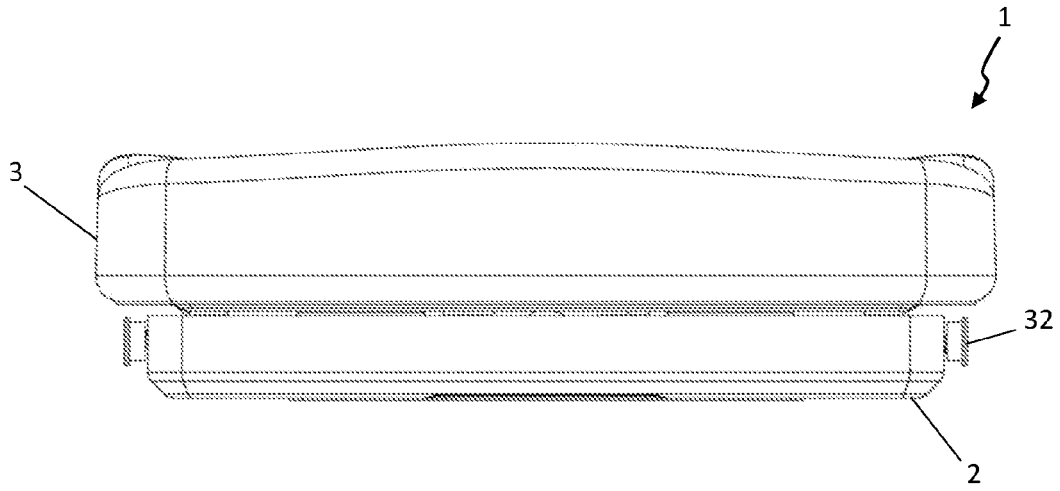
FIGS. 17 and 18 are each a front view of the sit assist device of FIG. 1, shown in a lowered position in FIG. 17 and a raised position in FIG. 18.
Figure 18:
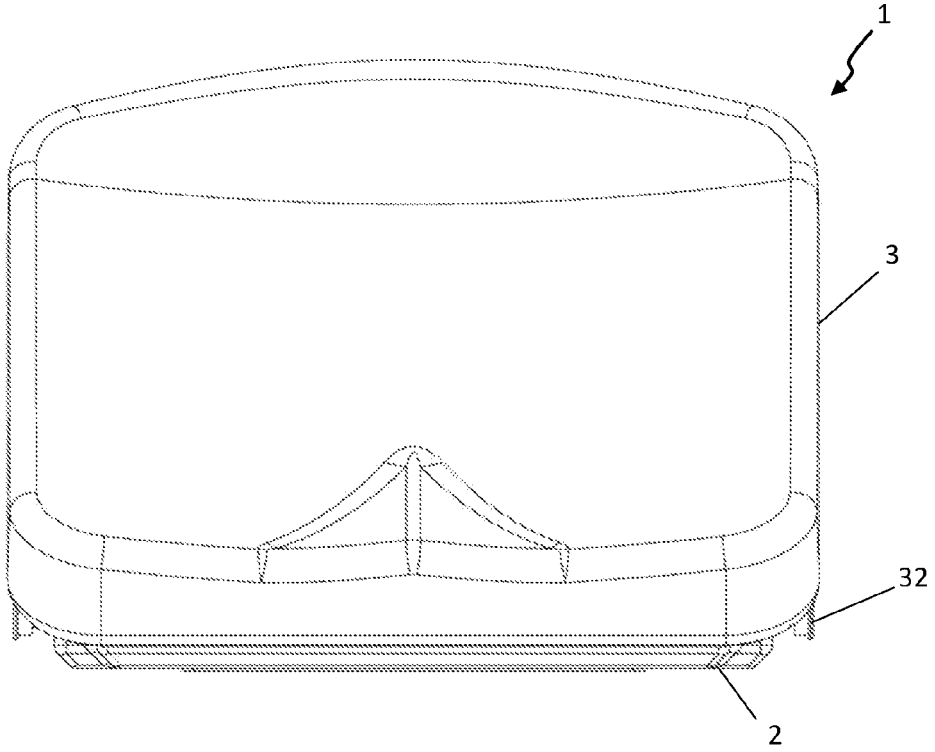
Figure 19:
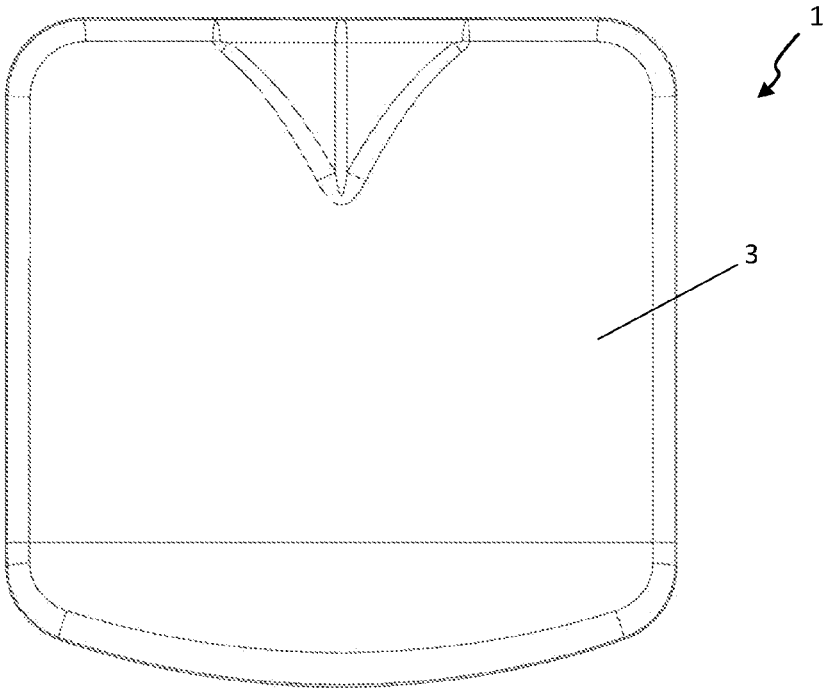
FIGS. 19 and 20 are each a top view of the sit assist device of FIG. 1, shown in a lowered position in FIG. 19 and a raised position in FIG. 20.
Figure 20:
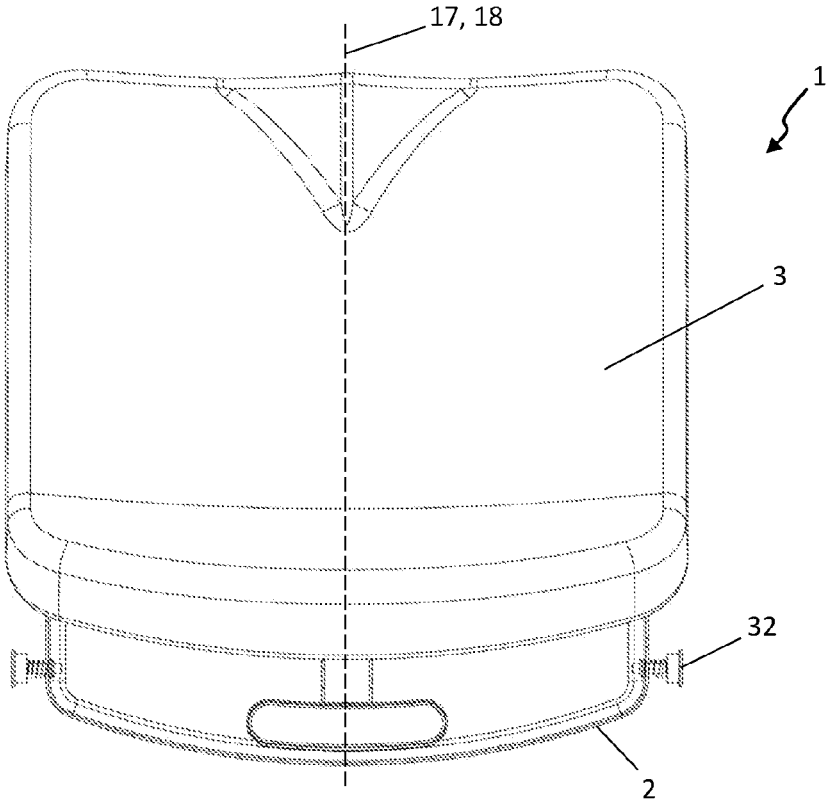
Figure 21:
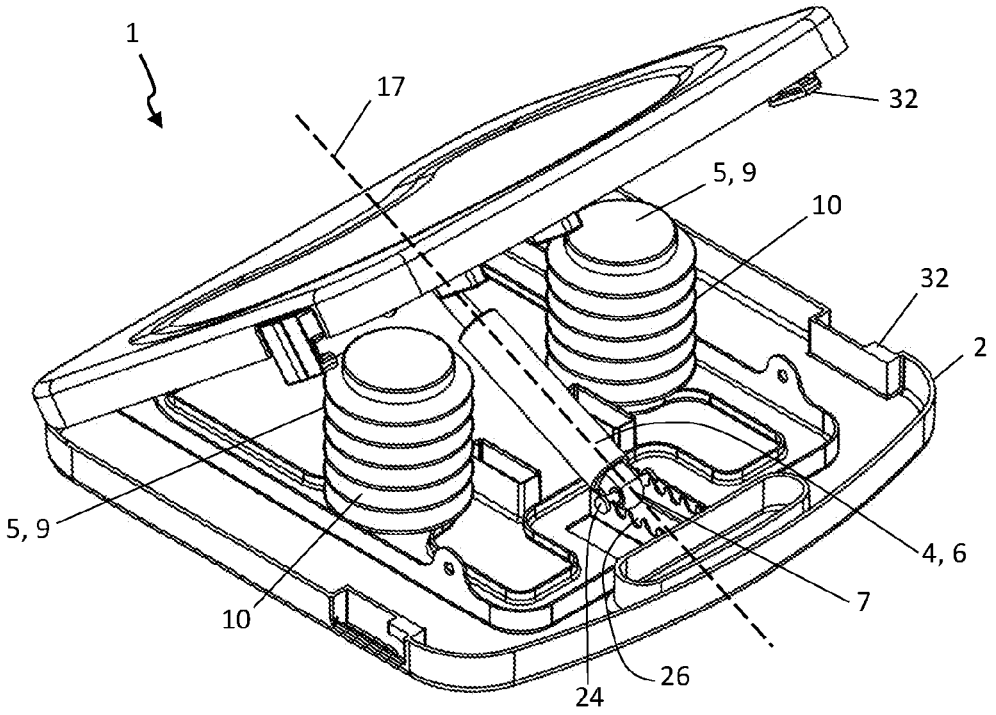
FIG. 21 is a top rear right isometric view of a sit assist device in accordance with an embodiment of the present invention, shown in a raised position.
Figure 22:
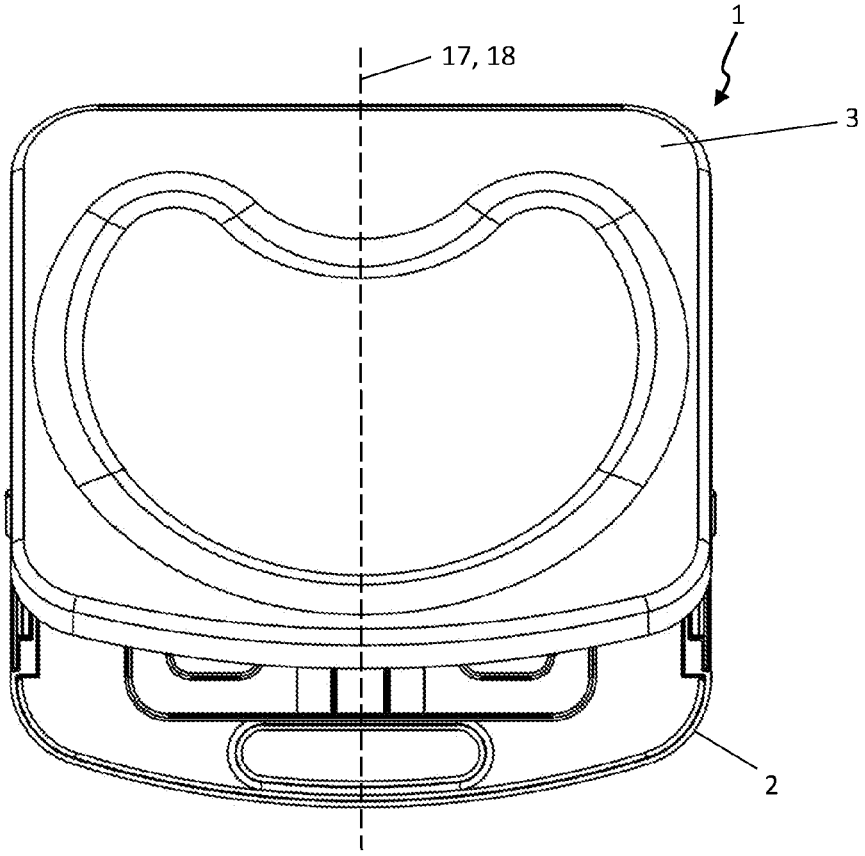
FIG. 22 is a top view of the sit assist device of FIG. 21, shown in a raised position.
Figure 23:
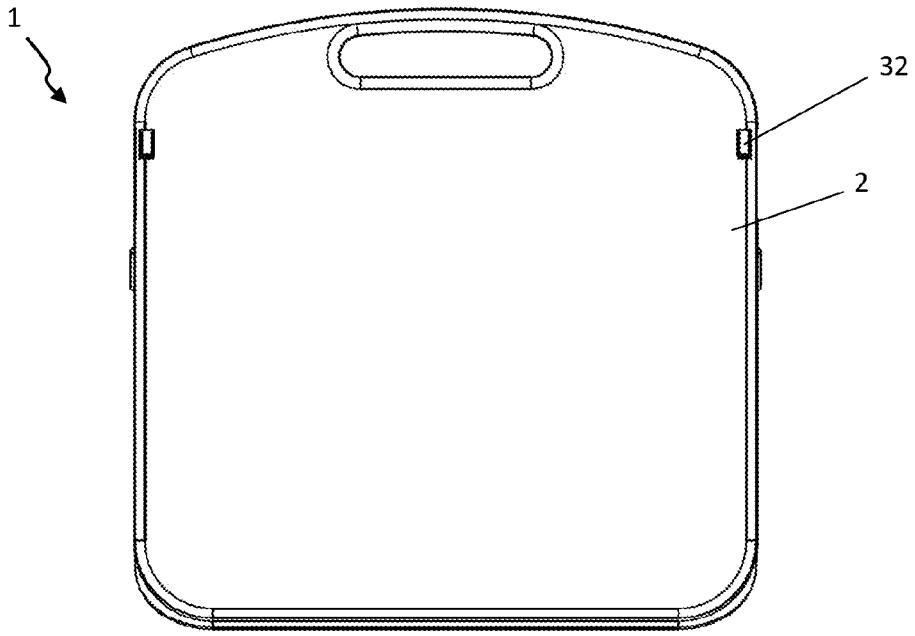
FIG. 23 is a bottom view of the sit assist device of FIG. 21.
Figure 24:
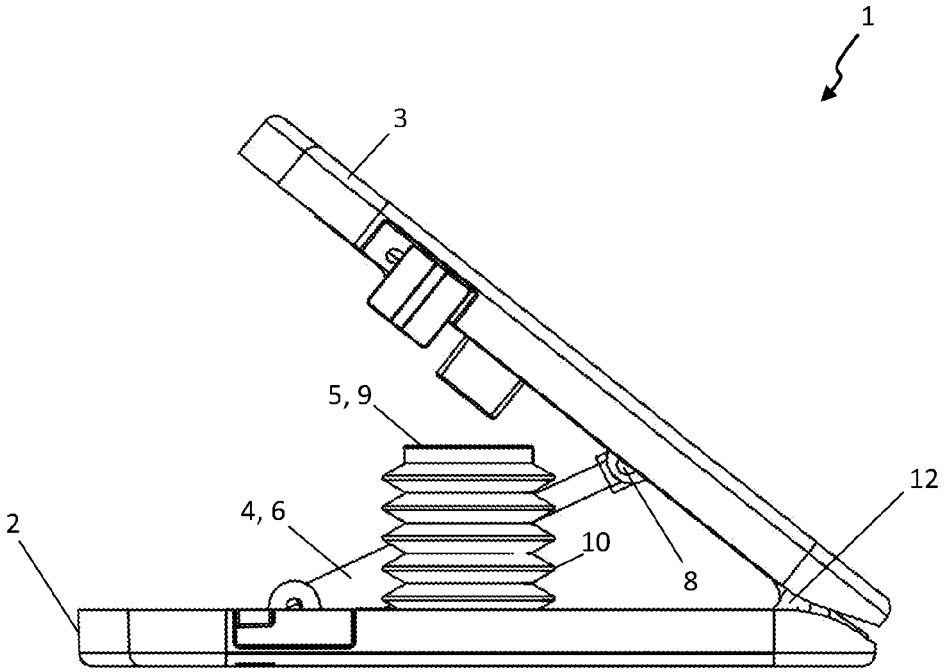
FIG. 24 is a left side view of the sit assist device of FIG. 21, shown in a raised position.
Figure 25:
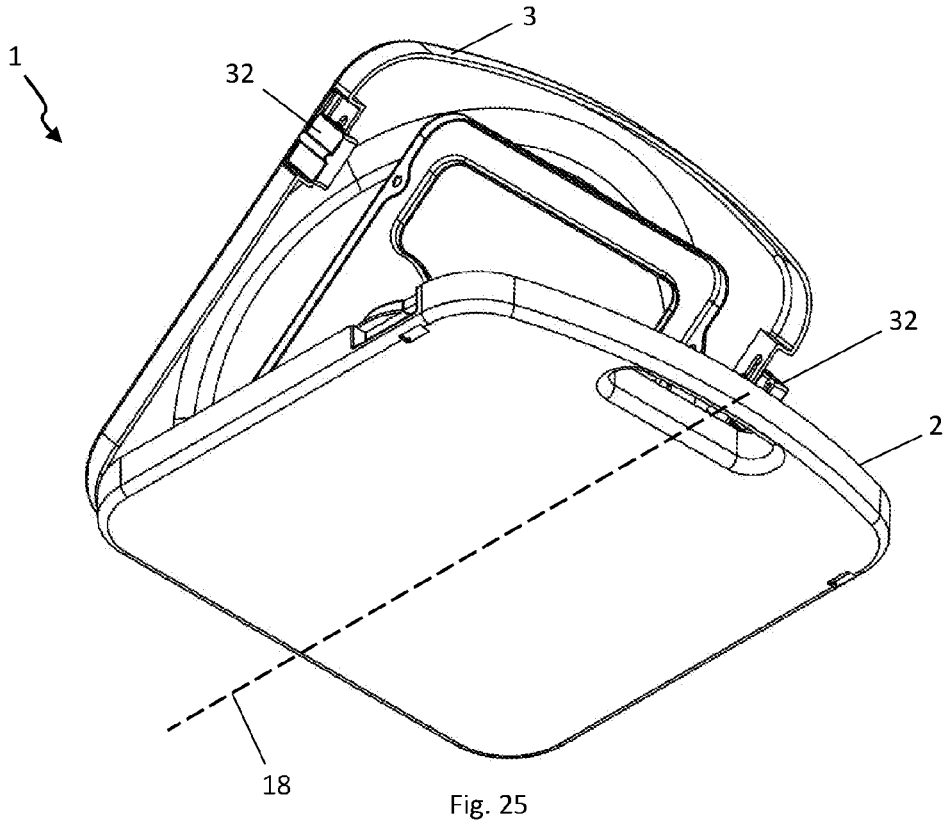
FIG. 25 is a bottom rear right isometric view of the sit assist device of FIG. 21, shown in a raised position.

Referring to the figures, there is provided a sit assist device 1 comprising a base 2 adapted to be supported by a seating surface, and a sitting platform 3 hingedly connected to the base 2 and movable between a raised position and a lowered position to assist a user to sit down onto and to stand up from the sitting platform 3. A primary biasing means 4 provides a primary resilient bias to resiliently bias the sitting platform 3 from the lowered position to the raised position over an operating range, thereby moving the sitting platform 3 from the lowered position to the raised position over the operating range as the user stands up from the sitting platform 3 and slowing the movement of the sitting platform 3 from the raised position to the lowered position over the operating range as the user sits down onto the sitting platform 3. A secondary biasing means 5 provides a secondary resilient bias to supplement the primary resilient bias over a portion of the operating range adjacent the lowered position.

This means that the secondary resilient bias starts to provide substantial resilient biasing force in addition to that provided by the primary resilient bias as the sitting platform 3 approaches the base 2 when moving from the raised position to the lowered position, and as the sitting platform 3 moves away the base 2 when moving from the lowered position to the raised position. This resolves or ameliorates the problem faced by prior sit assist devices where the force provided by a resilient biasing component, such as a spring damper cylinder, is quite weak in the vicinity of the lowered position since the resilient biasing component is operating at a very shallow angle from the base in the vicinity of the lowered position.

The primary biasing means 4 can comprise one or more of the following: a primary coil spring; a primary pneumatic spring; and a primary hydraulic spring. Apart from these listed components, it is appreciated that other components can be used as long as they can provide a primary resilient bias to resiliently bias the sitting platform 3 from the lowered position to the raised position over the operating range. It is also appreciated that when the qualifier "primary" is used herein to qualify components such as coil springs, pneumatic springs, hydraulic springs, spring dampers, and the like, which form the primary biasing means 4, the qualifier "primary" is simply used to differentiate components of a similar type used to form the secondary biasing means 5 described further below. In other words, the qualifier "primary" does not necessarily mean that the primary biasing means 4 must comprise more than one such component.

In the particular embodiments shown in the accompanying figures, the primary biasing means 4 comprises a primary spring damper 6. Having a damper component has the added advantage of enhancing the slowing of the movement of the sitting platform 3 from the raised position to the lowered position over the operating range as the user sits down and applies her/his weight onto the sitting platform 3. The primary spring damper 6 is hingedly connected at one end 7 to the base 2 and hingedly connected at another end 8 to the sitting platform 3. As the sitting platform 3 moves towards the lowered position, the spring damper 6 tilts further down with an increasingly shallow angle with the base 2 until the spring damper 6 lies substantially flat between the substantially parallel base 2 and sitting platform 3. In particular, the base 2 has one or more upwardly extending peripheral walls such that the spring damper 6 lies below the walls in the lowered position and is stowed between the base 2 and the sitting platform 3 in the lowered position, allowing the base 2 and the sitting platform 3 to adopt a parallel and flat configuration in the lowered position.

The secondary biasing means 5 can comprise one or more of the following: a secondary coil spring; and a secondary leaf spring. Apart from these listed components, it is appreciated that other components can be used as long as they can provide a secondary resilient bias to supplement the primary resilient bias over a portion of the operating range adjacent the lowered position. It is also appreciated that when the qualifier "secondary" is used herein to qualify components such as coil springs, leaf springs, and the like, which form the secondary biasing means 5, the qualifier "secondary" is simply used to differentiate components of a similar type used to form the primary biasing means 4 described above. In other words, the qualifier "secondary" does not necessarily mean that the secondary biasing means 5 must comprise more than one such component.

In the particular embodiments shown in accompanying FIGS. 1 to 25, the secondary biasing means 5 comprises at least one secondary coil spring 9 mounted vertically on the base 2 and having a height lower than the sitting platform 3 in the raised position such that the sitting platform 3 engages the secondary coil spring 9 only when the sitting platform 3 is lowered towards the lowered position, thereby providing the secondary resilient bias to supplement the primary resilient bias over a portion of the operating range adjacent the lowered position.

In other embodiments, the secondary biasing means 5 can comprise at least one secondary coil spring connected at one end to the base 2 and connected to the sitting platform 3 at another end. In these cases, the secondary coil spring is configured to provide the secondary resilient bias to substantively supplement the primary resilient bias over a portion of the operating range adjacent the lowered position. For example, the secondary coil spring can be wound such a first portion of the coil provides minimal resilient bias and a second portion provides substantially more resilient bias. In this way, the secondary coil spring will only provide substantive secondary resilient bias in the vicinity of the lowered position. In particular, when the sitting platform 3 first moves from the raised position towards the lowered position, only the first portion of the coil will compress thereby only providing minimal resilient bias. However, when the sitting platform 3 approaches the lowered position, the second portion of the coil will compress thereby providing substantive resilient bias. Similarly, when the sitting platform 3 first moves from the lowered position towards the raised position, the second portion of the coil will expand thereby providing substantive resilient bias. However, when the sitting platform 3 approaches the raised position, the second portion of the coil no longer expands and the first portion of the coil expands instead thereby providing minimal resilient bias.

Returning to the embodiments depicted in the figures, the secondary biasing means 5 comprises a respective spring cover 10 covering each secondary coil spring 9. For example, the spring cover 10 can be in the form of a rubber sleeve or barrel sleeved over the secondary coil spring 9. The spring cover 10 can have a rippled or concertina wall to facilitate compression and expansion of the secondary coil spring 9, as well as to provide mechanical protection and to act as a safety barrier.

Figure 29:
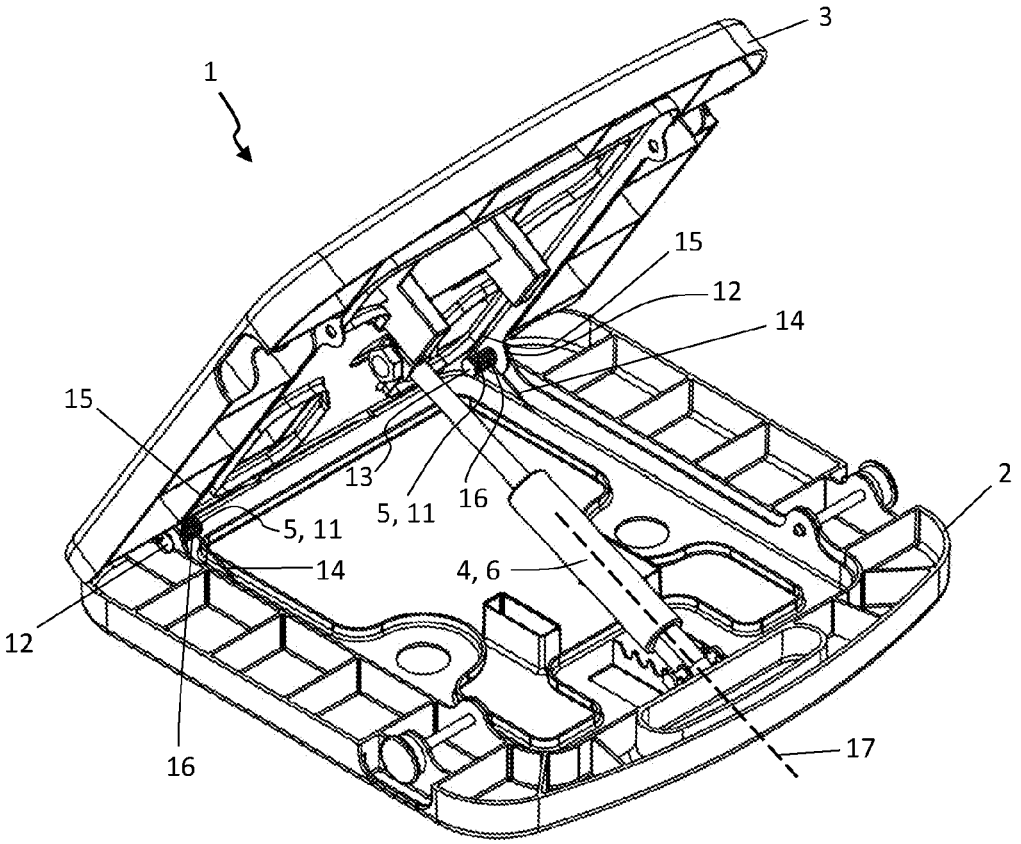
FIG. 29 is a top rear right isometric view of a sit assist device in accordance with a further embodiment of the present invention, shown in a raised position.
Figure 30:
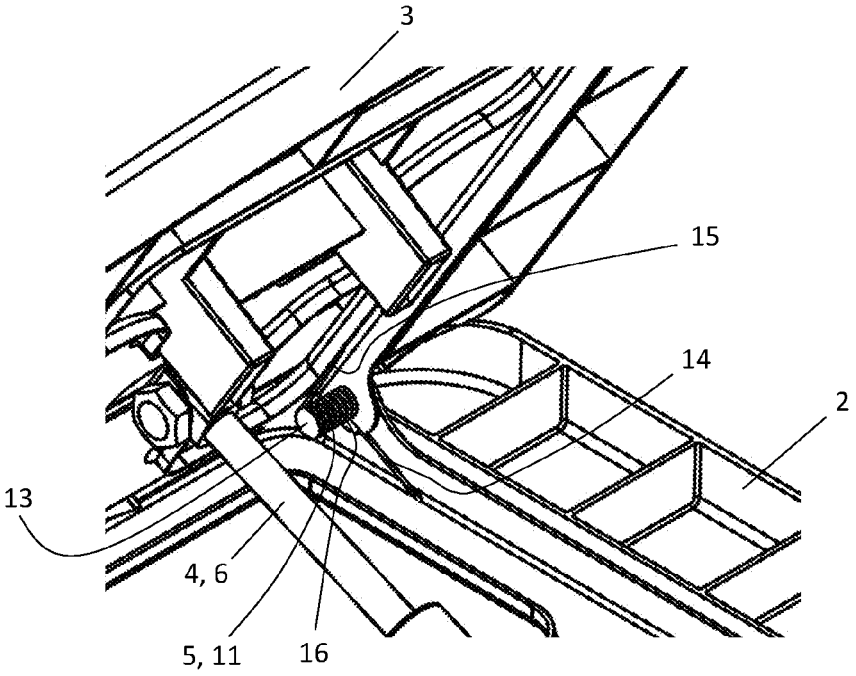
FIG. 30 is an inset view of a secondary biasing means in the form of a secondary coil spring sleeved on a cylindrical portion of a hinge of the sit assist device of FIG. 29.
Figure 31:
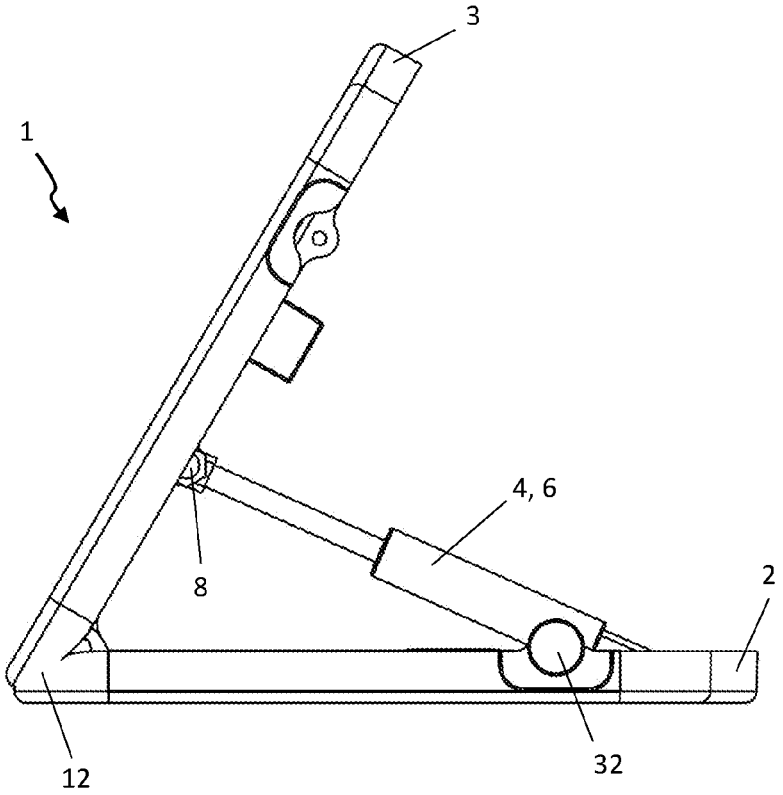
FIG. 31 is a right side view of the sit assist device of FIG. 29, shown in a raised position.
Figure 32:
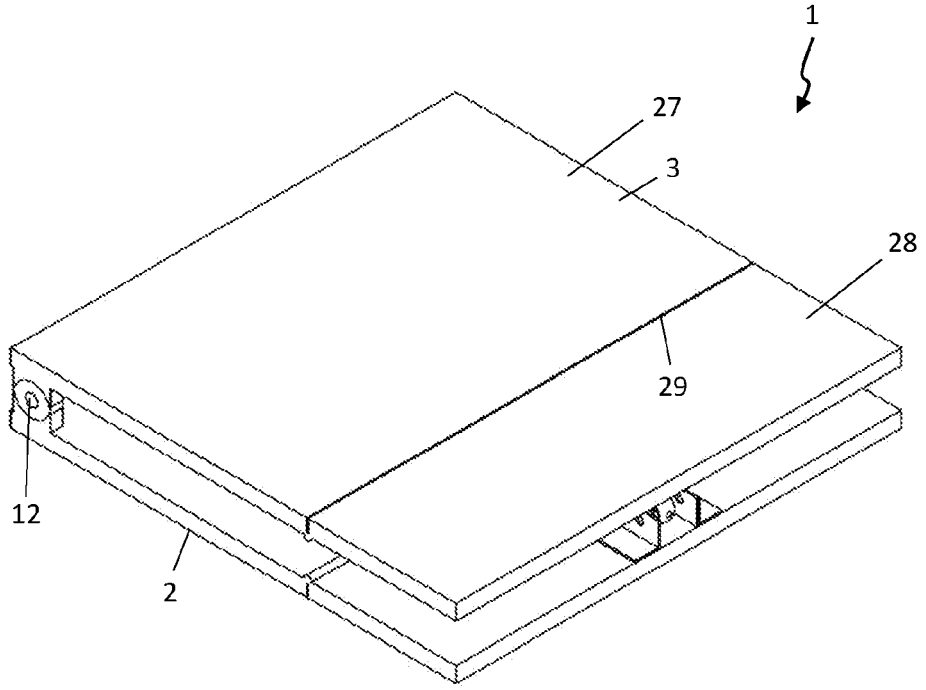
FIGS. 32 and 33 are each a top rear right isometric view of a sit assist device in accordance with another embodiment of the present invention, shown in a lowered position in FIG. 32 and a raised position in FIG. 33.
Figure 33:
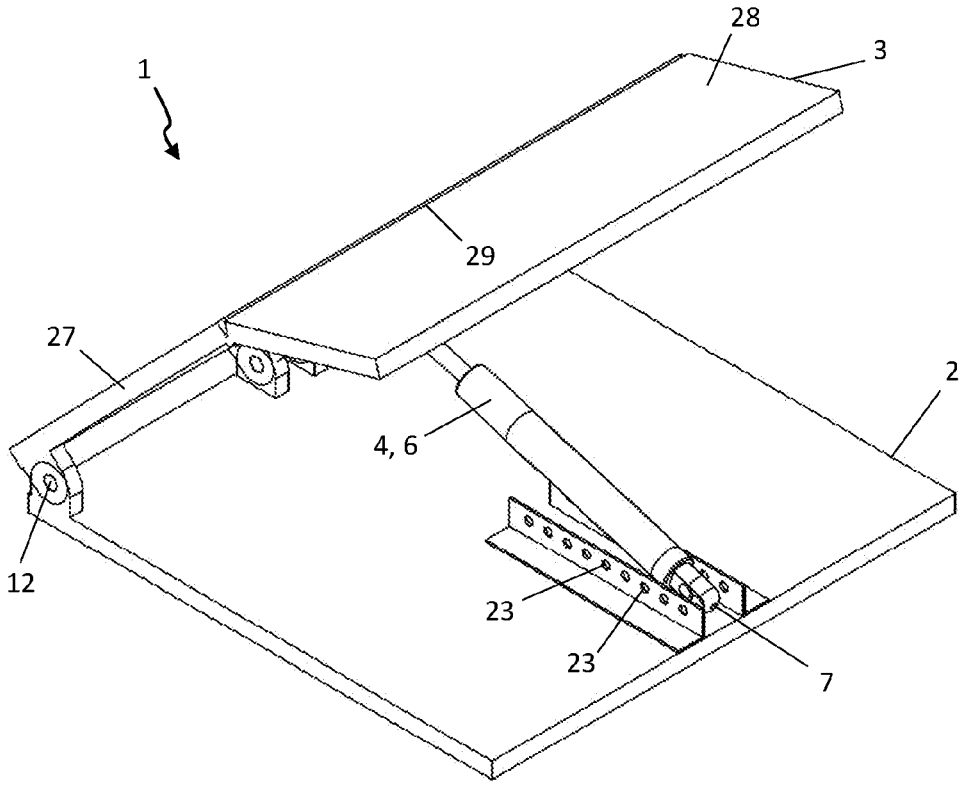
Figure 34:
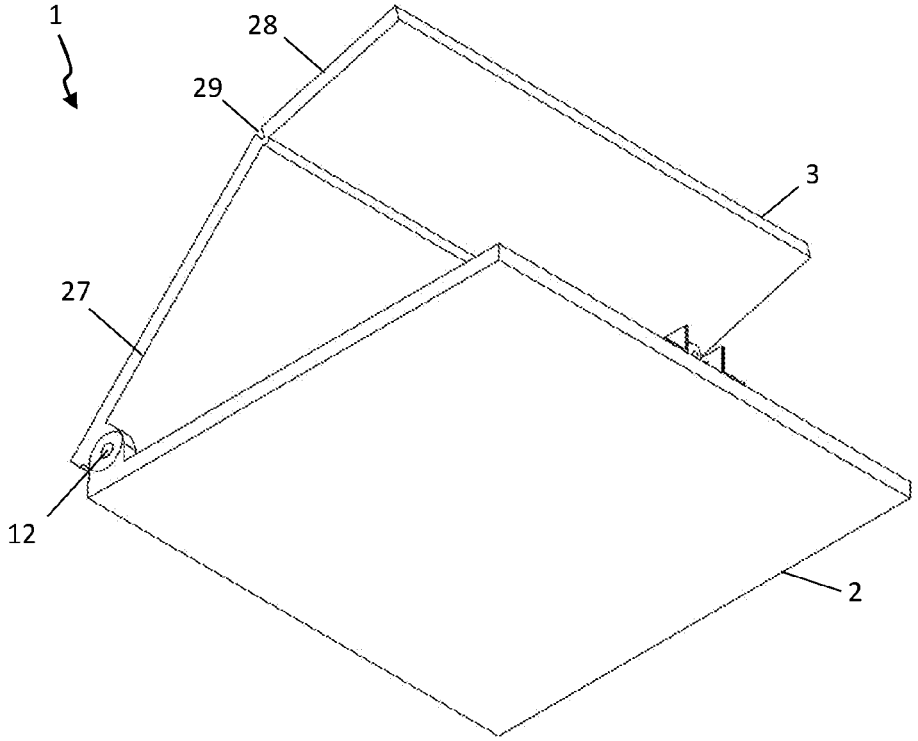
FIG. 34 is a bottom rear right isometric view of the sit assist device of FIG. 32, shown in a raised position.
Figure 35:
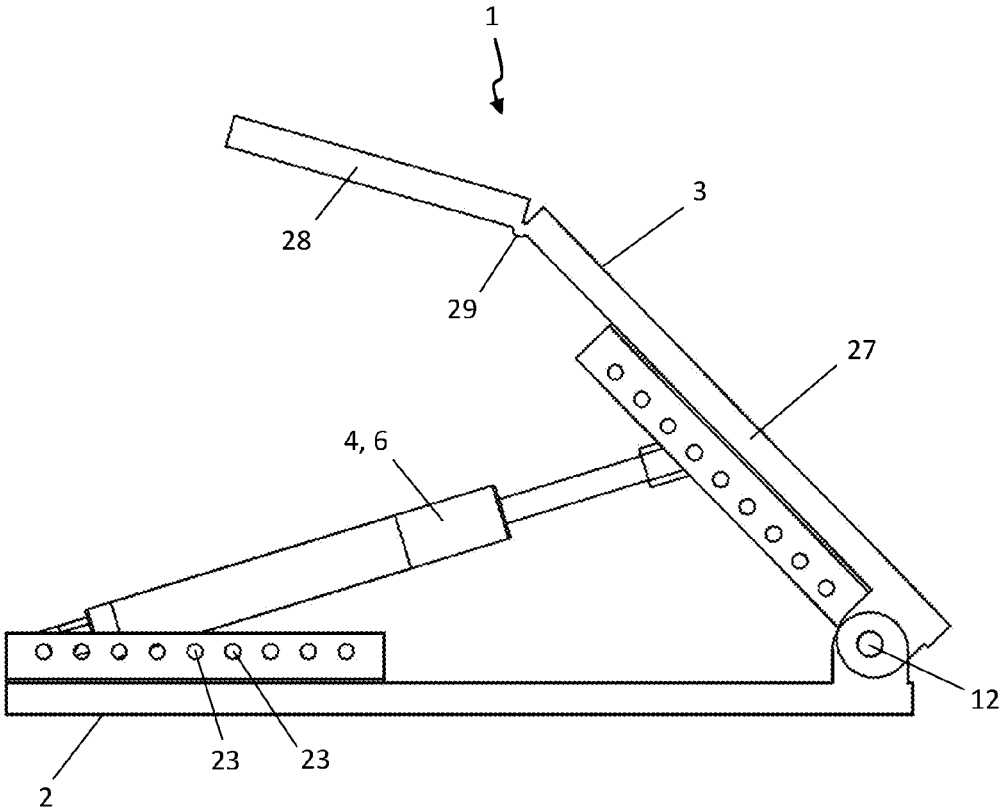
FIG. 35 is a left side view of the sit assist device of FIG. 32, shown in a raised position.

In the particular embodiments shown in accompanying FIGS. 29 to 31, the secondary biasing means 5 comprises at least one secondary coil spring 11, the secondary coil spring 11 forming part of a hinge 12 hingedly connecting the sitting platform 3 to the base 2. The hinge 12 comprises a cylindrical portion 13. For example, the cylindrical portion 13 is part of the sitting platform 3, and the base 2 has a retention hole. The retention hole is aligned with the cylindrical portion and a pin passes through the hole into the cylindrical portion 13 thereby hingedly interconnecting the base 2 and the sitting platform 3. The secondary coil spring 11 has a lower arm portion 14, an upper arm portion 15, and a coil portion 16 between the upper and lower arm portions. The coil portion 16 is sleeved over the cylindrical portion 13, the upper arm portion 15 is engaged with the sitting platform 3, and the lower arm portion 14 is engaged with the base 2. The secondary coil spring 11 is configured to provide the secondary resilient bias to substantively supplement the primary resilient bias over a portion of the operating range adjacent the lowered position.

The primary biasing means 4 operates along a longitudinal axis 17 and is positioned with the longitudinal axis substantially aligned with a central front-to-back axis 18 running from a centre front of the base 2 to a centre rear of the base 2. The secondary biasing means 5 has two of said secondary coil springs 9 (or two of said secondary coil springs 11) positioned on either side of the longitudinal axis 17. This ensures that the sitting platform 3 is properly balanced over the base 2, even with rough use.

Figure 26:
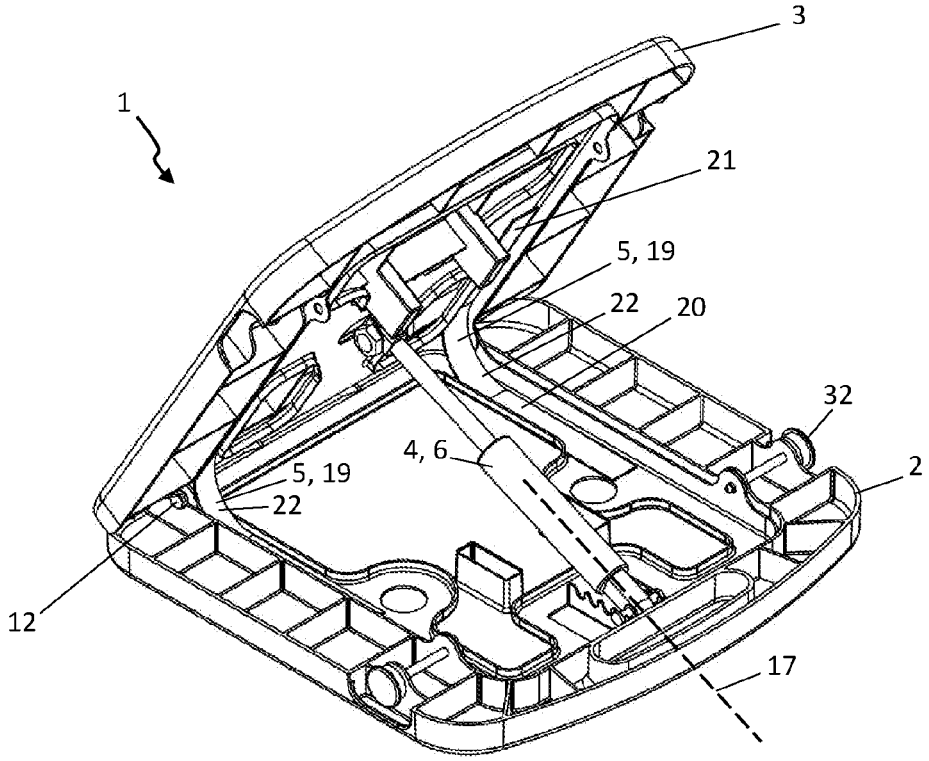
FIG. 26 is a top rear right isometric view of a sit assist device in accordance with another embodiment of the present invention, shown in a raised position.
Figure 27:
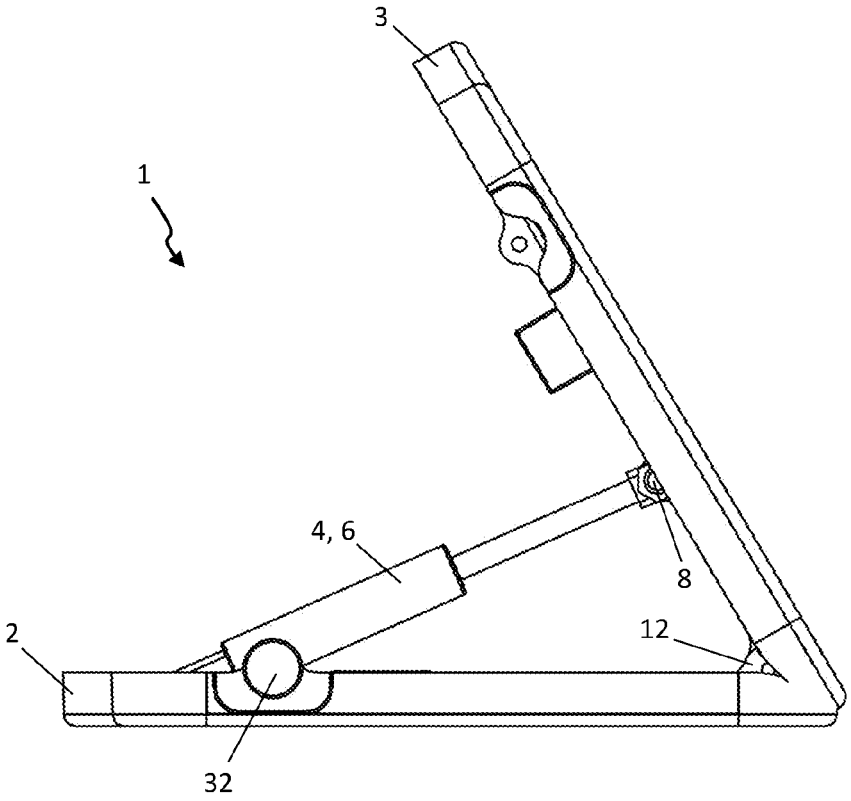
FIG. 27 is a left side view of the sit assist device of FIG. 26, shown in a raised position.
Figure 28:
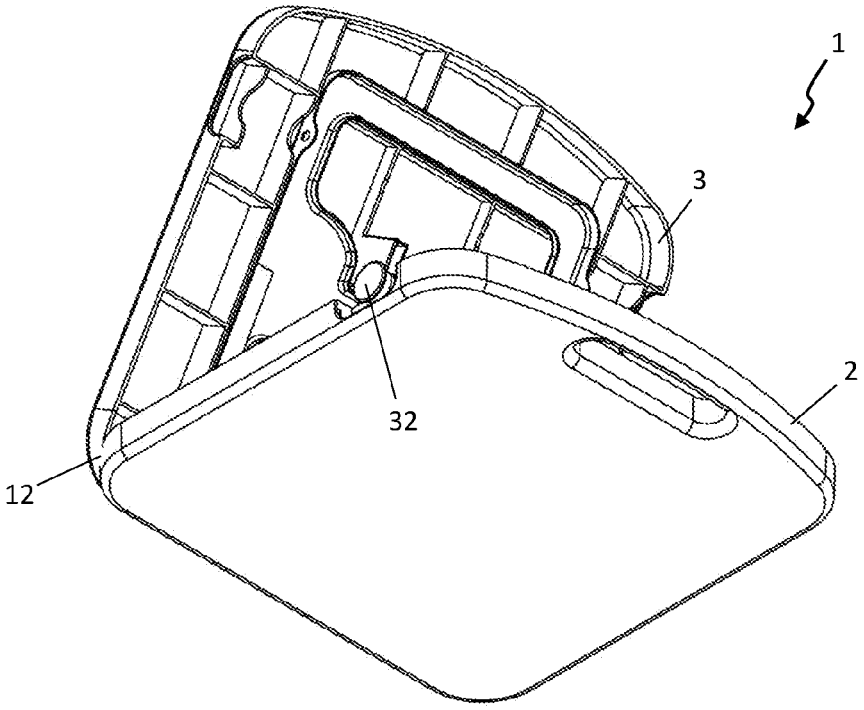
FIG. 28 is a bottom rear right isometric view of the sit assist device of FIG. 26, shown in a raised position.

In the particular embodiments shown in accompanying FIGS. 26 to 28, the secondary biasing means 5 comprises at least one secondary leaf spring 19 having a lower arm portion 20, an upper arm portion 21, and a resilient elbow portion 22 between the upper and lower arm portions. The lower arm portion 20 is connected to the base 2 and the upper arm portion 21 is connected to the sitting platform 3. The secondary leaf spring 19 is configured to provide the secondary resilient bias to supplement the primary resilient bias as the upper and lower arm portions are urged together over a portion of the operating range adjacent the lowered position. For example, the secondary leaf spring 19 can be selected such that will only provide substantive secondary resilient bias in the vicinity of the lowered position. In particular, the material properties of the resilient elbow portion 22, or the bend radius of the resilient elbow portion 22 can be designed so that the secondary leaf spring 19 will only provide substantive secondary resilient bias as the sitting platform 3 approaches the lowered position and as the sitting platform 3 starts to move away from the lowered position.

The secondary leaf spring 19 can form at least part of a hinge hingedly connecting the sitting platform to the base.

In other embodiments, the secondary biasing means 5 comprises at least one secondary leaf spring having a lower arm portion, an upper arm portion, and a resilient elbow portion between the upper and lower arm portions. The lower arm portion is connected to the base 2 and the upper arm portion is unconnected to and lower than the sitting platform 3 in the raised position such that the sitting platform 3 engages the secondary leaf spring only when the sitting platform 3 is lowered towards the lowered position, thereby providing the secondary resilient bias to supplement the primary resilient bias as the upper and lower arm portions are urged together over a portion of the operating range adjacent the lowered position.

Returning to the embodiments depicted in the figures, the primary biasing means 4 is hingedly connected at one end 7 to the base 2 and hingedly connected at another end 8 to the sitting platform 3. One or both of the ends 7 and 8 of the primary biasing means 4 is movable along a plurality of connection points 23 running along the base 2 and/or the sitting platform 3 to adjust the raised position and/or a force profile of the primary biasing means 4 over the operating range. In the particular embodiments shown, one end 7 of the primary biasing means 4 includes a transverse locating pin 24 having pin ends that extend beyond either side of the end 7 of the primary biasing means 4. The plurality of connection points 23 are formed by two parallel upstanding flanges 25 each comprising a series of cutouts 26 having a shape complementary to the locating pin 24. Each cutout 26 on a flange 25 opposes a corresponding cutout 26 on the other flange thereby defining a connection point 23. The locating pin 24 is moved to one of these connection points 23 where the pin ends of the locating pin 24 are retained in the cutouts 26 of the connection point 23.

The sitting platform 3 comprises a front portion 27 and a rear portion 28. The front portion 27 is hingedly connected to the base 2. The front 27 and rear 28 portions are hingedly interconnected such that the rear portion 28 maintains a substantially horizontal configuration when the user sits down onto the sitting platform 3 as the sitting platform moves from the raised position to the lowered position, and/or when the user stands up from the sitting platform 28 as the sitting platform moves from the lowered position to the raised position. The hinged connection 29 can be in the form of a weakened section integral with the sitting platform 3 between the front 27 and rear 28 portions.

The base 2 can be a single integrated unit and/or the sitting platform 3 can be a single integrated unit. This greatly simplifies assembly of the sit assist device 1. For example, the base can be a single molded unit and/or the sitting platform 3 can be a single molded unit.

In some embodiments, the sitting platform 3 comprises a rigid portion 30 and a cushioned portion 31 mounted to the rigid portion for the user to sit upon.

Conveniently, the sit assist device 1 includes a locking mechanism 32 for locking the sitting platform 3 to the base 2 in the lowered position for storage. For example, the locking mechanism 32 can be in the form of a latch and catch, or a pin and hole, either of which can be spring operated.

It is appreciated that the aforesaid embodiments are only exemplary embodiments adopted to describe the principles of the present invention, and the present invention is not merely limited thereto. Various variants and modifications can be made by those of ordinary skill in the art without departing from the spirit and essence of the present invention, and these variants and modifications are also covered within the scope of the present invention. Accordingly, although the invention has been described with reference to specific examples, it is appreciated by those skilled in the art that the invention can be embodied in many other forms. It is also appreciated by those skilled in the art that the features of the various examples described can be combined in other combinations.

It is claimed:

1. A sit assist device comprising:

a base adapted to be supported by a seating surface;

a sitting platform hingedly connected to the base and movable between a raised position and a lowered position to assist a user to sit down onto and to stand up from the sitting platform;

a primary biasing means providing a primary resilient bias to resiliently bias the sitting platform from the lowered position to the raised position over an operating range, thereby moving the sitting platform from the lowered position to the raised position over the operating range as the user stands up from the sitting platform and slowing the movement of the sitting platform from the raised position to the lowered position over the operating range as the user sits down onto the sitting platform; and a secondary biasing means providing a secondary resilient bias to supplement the primary resilient bias over a portion of the operating range adjacent the lowered position.

2. A sit assist device according to claim 1 wherein the primary biasing means comprises one or more of the following: a primary coil spring; a primary pneumatic spring; and a primary hydraulic spring.

3. A sit assist device according to claim 1 wherein the primary biasing means comprises a primary spring damper.

4. A sit assist device according to claim 3 wherein the primary spring damper is hingedly connected at one end to the base and hingedly connected at another end to the sitting platform.

5. A sit assist device according to claim 1 wherein the secondary biasing means comprises one or more of the following: a secondary coil spring; and a secondary leaf spring.

6. A sit assist device according to claim 5 wherein the secondary biasing means comprises at least one secondary coil spring mounted vertically on the base and having a height lower than the sitting platform in the raised position such that the sitting platform engages the secondary coil spring only when the sitting platform is lowered towards the lowered position, thereby providing the secondary resilient bias to supplement the primary resilient bias over a portion of the operating range adjacent the lowered position.

7. A sit assist device according to claim 6 wherein the secondary biasing means comprises a respective spring cover covering each secondary coil spring.

8. A sit assist device according to claim 6 wherein the primary biasing means operates along a longitudinal axis and is positioned with the longitudinal axis substantially aligned with a central front-to-back axis running from a centre front of the base to a centre rear of the base, the secondary biasing means having two of said secondary coil springs positioned on either side of the longitudinal axis.

9. A sit assist device according to claim 5 wherein the secondary biasing means comprises at least one secondary coil spring connected at one end to the base and connected to the sitting platform at another end, the secondary coil spring configured to provide the secondary resilient bias to supplement the primary resilient bias over a portion of the operating range adjacent the lowered position.

10. A sit assist device according to claim 5 wherein the secondary biasing means comprises at least one secondary coil spring, the secondary coil spring forming part of a hinge hingedly connecting the sitting platform to the base.

11. A sit assist device according to claim 10 wherein the hinge comprises a cylindrical portion, the secondary coil spring has a lower arm portion, an upper arm portion, and a coil portion between the upper and lower arm portions, with the coil portion sleeved over the cylindrical portion, the upper arm portion engaged with the sitting platform, and the lower arm portion engaged with the base, the secondary coil spring configured to provide the secondary resilient bias to supplement the primary resilient bias over a portion of the operating range adjacent the lowered position.

12. A sit assist device according to claim 5 wherein the secondary biasing means comprises at least one secondary leaf spring having a lower arm portion, an upper arm portion, and a resilient elbow portion between the upper and lower arm portions, with the lower arm portion connected to the base and the upper arm portion connected to the sitting platform, the secondary leaf spring configured to provide the secondary resilient bias to supplement the primary resilient bias as the upper and lower arm portions are urged together over a portion of the operating range adjacent the lowered position.

13. A sit assist device according to claim 12 wherein the secondary leaf spring forms at least part of a hinge hingedly connecting the sitting platform to the base.

14. A sit assist device according to claim 5 wherein the secondary biasing means comprises at least one secondary leaf spring having a lower arm portion, an upper arm portion, and a resilient elbow portion between the upper and lower arm portions, with the lower arm portion connected to the base and the upper arm portion unconnected to and lower than the sitting platform in the raised position such that the sitting platform engages the secondary leaf spring only when the sitting platform is lowered towards the lowered position, thereby providing the secondary resilient bias to supplement the primary resilient bias as the upper and lower arm portions are urged together over a portion of the operating range adjacent the lowered position.

15. A sit assist device according to claim 1 wherein the primary biasing means is hingedly connected at one end to the base and hingedly connected at another end to the sitting platform, one or both of the ends of the primary biasing means being movable along a plurality of connection points running along the base and/or the sitting platform to adjust the raised position and/or a force profile of the primary biasing means over the operating range.

16. A sit assist device according to claim 1 wherein the sitting platform comprises a front portion and a rear portion, the front portion being hingedly connected to the base, and the front and rear portions are hingedly interconnected such that the rear portion maintains a substantially horizontal configuration when the user sits down onto the sitting platform as the sitting platform moves from the raised position to the lowered position, and/or when the user stands up from the sitting platform as the sitting platform moves from the lowered position to the raised position.

17. A sit assist device according to claim 16 wherein the hinged connection is in the form of a weakened section integral with the sitting platform between the front and rear portions.

18. A sit assist device according to claim 1 wherein the base is a single integrated unit and/or the sitting platform is a single integrated unit.

19. A sit assist device according to claim 18 wherein the base is a single molded unit and/or the sitting platform is a single molded unit.

20. A sit assist device according to claim 1 wherein the sitting platform comprises a rigid portion and a cushioned portion mounted to the rigid portion for the user to sit upon.

* * * * *